US011293274B2

(12) United States Patent
Moberg

(10) Patent No.: US 11,293,274 B2
(45) Date of Patent: Apr. 5, 2022

(54) DRILL PIPE SEGMENT LIFE MONITOR

(71) Applicant: Caterpillar Global Mining Equipment LLC, Denison, TX (US)

(72) Inventor: Carl J. Moberg, Dunlap, IL (US)

(73) Assignee: Caterpillar Global Mining Equipment LLC, Denison, TX (US)

( * ) Notice: Subject to any disclaimer, the term of this patent is extended or adjusted under 35 U.S.C. 154(b) by 36 days.

(21) Appl. No.: 16/822,843

(22) Filed: Mar. 18, 2020

(65) Prior Publication Data

US 2021/0293131 A1 Sep. 23, 2021

(51) Int. Cl.

| | |
|---|---|
| ***E21B 47/007*** | (2012.01) |
| ***E21B 47/12*** | (2012.01) |
| ***E21B 47/06*** | (2012.01) |
| ***E21B 44/00*** | (2006.01) |

(52) U.S. Cl.
CPC ..... *E21B 47/007* (2020.05); *E21B 44/00* (2013.01); *E21B 47/06* (2013.01); *E21B 47/12* (2013.01)

(58) Field of Classification Search
CPC ..... E21B 47/007; E21B 44/00; E21B 47/06; E21B 47/12
See application file for complete search history.

(56) References Cited

U.S. PATENT DOCUMENTS

| | | | | |
|---|---|---|---|---|
| 5,168,937 | A * | 12/1992 | Hamner | E21B 19/084 173/4 |
| 5,202,680 | A | 4/1993 | Savage | |
| 8,831,894 | B2 | 9/2014 | Papadimitriou et al. | |
| 9,637,981 | B2 | 5/2017 | Kirkhope | |
| 9,696,198 | B2 | 7/2017 | Turner et al. | |
| 10,287,870 | B2 | 5/2019 | Dahl | |
| 10,422,188 | B2 | 9/2019 | Zheng et al. | |
| 2013/0327543 | A1* | 12/2013 | Reddy | E21B 19/083 166/381 |
| 2014/0338975 | A1* | 11/2014 | Hoult | E21B 47/024 175/40 |
| 2016/0060980 | A1* | 3/2016 | Magnuson | E21B 19/155 340/666 |
| 2020/0326226 | A1* | 10/2020 | Camacho Cardenas | E21B 19/008 |

* cited by examiner

*Primary Examiner* — Caroline N Butcher
(74) *Attorney, Agent, or Firm* — von Briesen & Roper, s.c.

(57) ABSTRACT

A drilling machine includes a pipe life monitoring system. The drilling machine includes a drill string with at least a rotary drill head assembly and a pipe segment. A sensor is configured to monitor and transmit sensor data, including at least one of a pressure and a torque. A controller, including a processor and being operatively associated with the sensor, is configured to calculate a weight of the pipe segment using the sensor data.

20 Claims, 7 Drawing Sheets

DRILL PIPE SEGMENT LIFE MONITOR

TECHNICAL FIELD

The present disclosure generally relates to drilling machines and, more specifically, to systems and methods for monitoring life of a pipe segment of the drilling machine.

BACKGROUND

Drilling machines may be used for sub-surface mineral extraction, such as, e.g., oil or natural gas; mineral exploration or environmental exploration drilling; hydraulic fracturing; oil, gas, and/or water extraction wells; rock cut drilling for mining and/or quarrying operations; and the like. Mobile drilling machines, such as blasthole drilling machines, are typically used for drilling blastholes for mining, quarrying, dam construction, and road construction, among other uses. The process of excavating rock, or other material, by blasthole drilling comprises using the blasthole drill machine to drill a plurality of holes into the rock and filling the holes with explosives. The explosives are detonated, causing the rock to collapse. The rubble is removed, and the newly formed surface is reinforced.

Components of drilling machines are subject to mechanical stress, pressure, and temperature. Among other things, while drilling, loose material may accumulate on top of the drill bit causing air pressure to increase around the drill bit, and forming an elevator of air around the pipe segments forming the drill string. These conditions erode the walls of the pipe segments, causing the walls to become thinner and more fragile. As the walls of the pipe segment erode, the weight of the pip segment decreases. While the position of the pipe segments may be rotated or alternated, the pipe segments are repeatedly used, and can become damaged over time. Failure of a pipe segment during operation may result in a shutdown of drilling operations while the failed pipe segment is retrieved from the borehole and repaired or replaced. Any shutdown of a drilling machine results in lost time and income. As such, operators and technicians may manually measure the wall thickness of each pipe segment to determine whether the wall of the pipe segment has worn too much. However, manual measurement is not only time consuming and inefficient, but also raises issues of inaccuracy and imprecision resulting from human error.

Prior attempts to predict the longevity of drill pipes have been directed to measuring mechanical stresses, loads, and temperature to determine an extent of damage to the pipe segment. For example, U.S. Pat. No. 10,287,870 discloses a system utilizing sensors placed at a surface of a work site to measure axial load data, drill string torque, rotary speed, mud flow rates, temperature, depth and time, among information. The system also utilizes sensors placed down the borehole, which measure downhole loads on the drill string. A processor analyzes the sensor data to determine a stress distribution and cumulative fatigue damage of at least a part of the drill string.

There is consequently a need for a system capable of calculating a weight of a pipe segment before its installation on a drill string or as it is removed from the drill string, in order to accurately determine erosion of the pipe segment wall and to determine the remaining life of the pipe segment.

SUMMARY

In accordance with one aspect of the present disclosure, an drilling machine with a pipe life monitoring system is disclosed. The drilling machine may comprise a drill string including at least a rotary drill head assembly and a pipe segment. The drilling machine may also include a sensor configured to monitor and transmit sensor data including at least one of a pressure and a torque. A controller, including a processor, may be operatively associated with the sensor. The controller may be configured to calculate a weight of the pipe segment using the transmitted sensor data.

In accordance with another aspect of the present disclosure, a pipe life monitoring system for use with a drilling machine is disclosed. The drilling machine may include a drill string with a rotary drill head assembly. The pipe life monitoring system may include a sensor configured to monitor and transmit sensor data including at least one of a pressure and a torque. The pipe life monitoring system may further include a controller, including a processor, in operative communication with the sensor. The controller may be configured to receive the sensor data transmitted by the sensor, and calculate a weight of the drill string using the received sensor data. After a pipe segment is installed on the drill string, the controller may also be configured to calculate a weight of the pipe segment using the received sensor data, calculate a pipe weight ratio based on the calculated weight of the pipe segment and a manufacturing weight of the pipe segment, and transmit a pipe segment failure warning to an operator of the drilling machine, if the calculated weight ratio exceeds a predetermined ratio threshold value.

In accordance with yet another aspect of the present disclosure, a method of detecting failure of a pipe segment installed on a drill string of a drilling machine is disclosed. The drill string may include a rotary drill head assembly. The method may include receiving initial sensor data from one of a pressure sensor and a torque sensor. The method may also include calculating an initial weight of the drill string using the received initial sensor data, and installing a pipe segment on the drill string. Furthermore, the method may include receiving updated sensor data from the one of the pressure sensor and the torque sensor, calculating an updated weight of the drill string using the received updated sensor data, calculating an initial weight of the pipe segment by subtracting the initial weight of the drill string from the updated weight of the drill string, and calculating an initial pipe weight ratio based on the calculated initial weight of the pipe segment and a manufacturing weight of the pipe segment. Finally, the method may include transmitting a pipe segment failure warning to an operator of the drilling machine if the calculated initial pipe weight ratio exceeds a predetermined ratio threshold value.

These and other aspects and features of the present disclosure will be better understood upon reading the following detailed description, when taken in conjunction with the accompanying drawings.

DETAILED DESCRIPTION

Reference will now be made in detail to specific embodiments or features, examples of which are illustrated in the accompanying drawings. Wherever possible, corresponding or similar reference numbers will be used throughout the drawings to refer to the same or corresponding parts.

Figure 1:
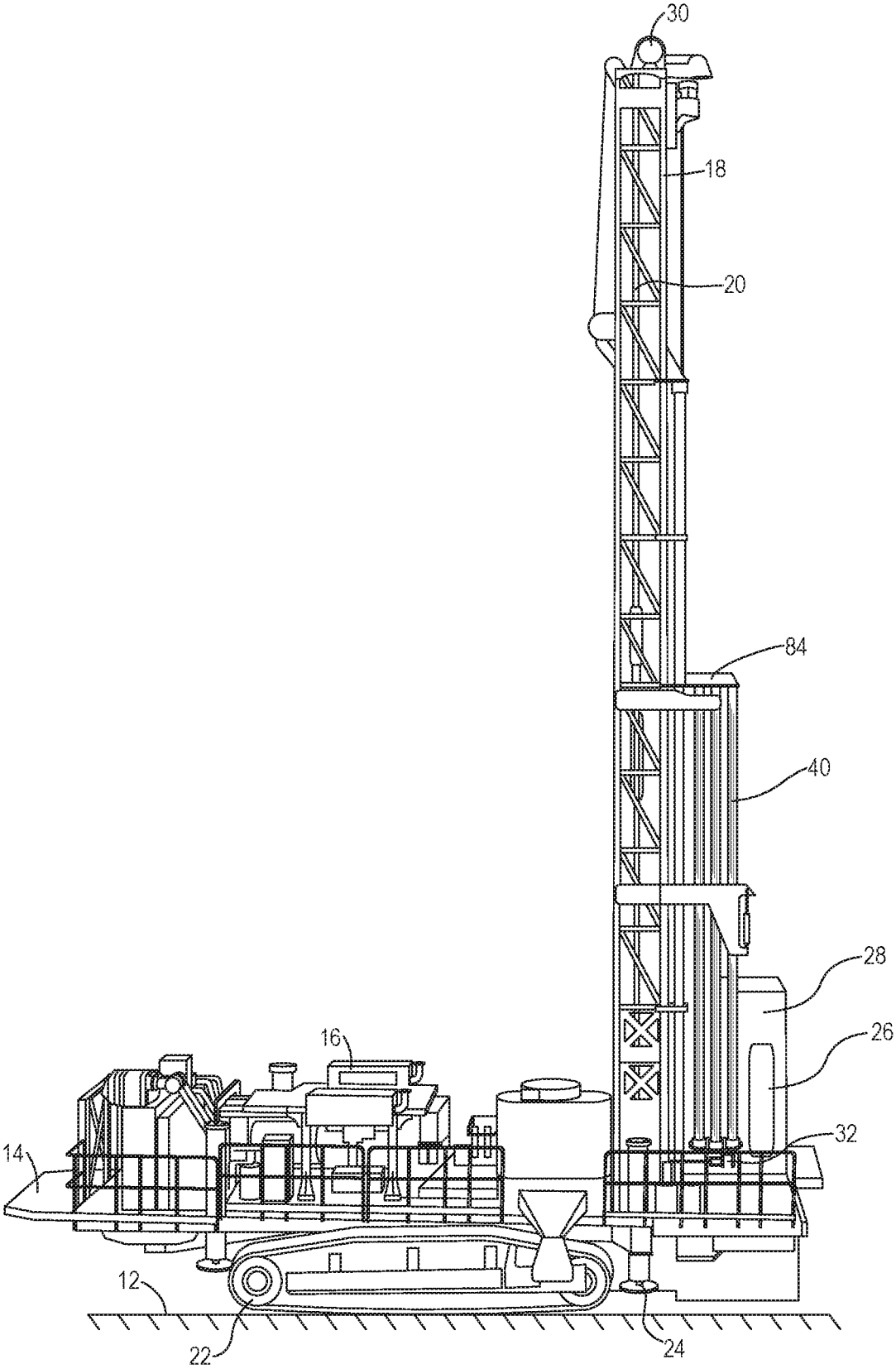
FIG. 1 is a side perspective view of a drilling machine at a work site, in accordance with an embodiment of the present disclosure.

Referring now to FIG. 1, an exemplary drilling machine 10 operating at a worksite is illustrated. While the drilling machine 10 illustrated in FIG. 1 is a rotary blasthole drill rig, the features disclosed herein may be utilized with other types of drilling machines for drilling or otherwise forming holes, channels, tunnels or openings into, within, and/or extending into and/or below a work surface 12 of the worksite. However, it should be understood that the spirit and scope of the present disclosure includes any machine, machine system, or application which can implement the system and method for monitoring a condition of a pipe segment according to any embodiment of the present disclosure, including, but not limited to, types of drilling machines which can vary from the drilling machine 10 illustrated in FIG. 1.

Figure 4:
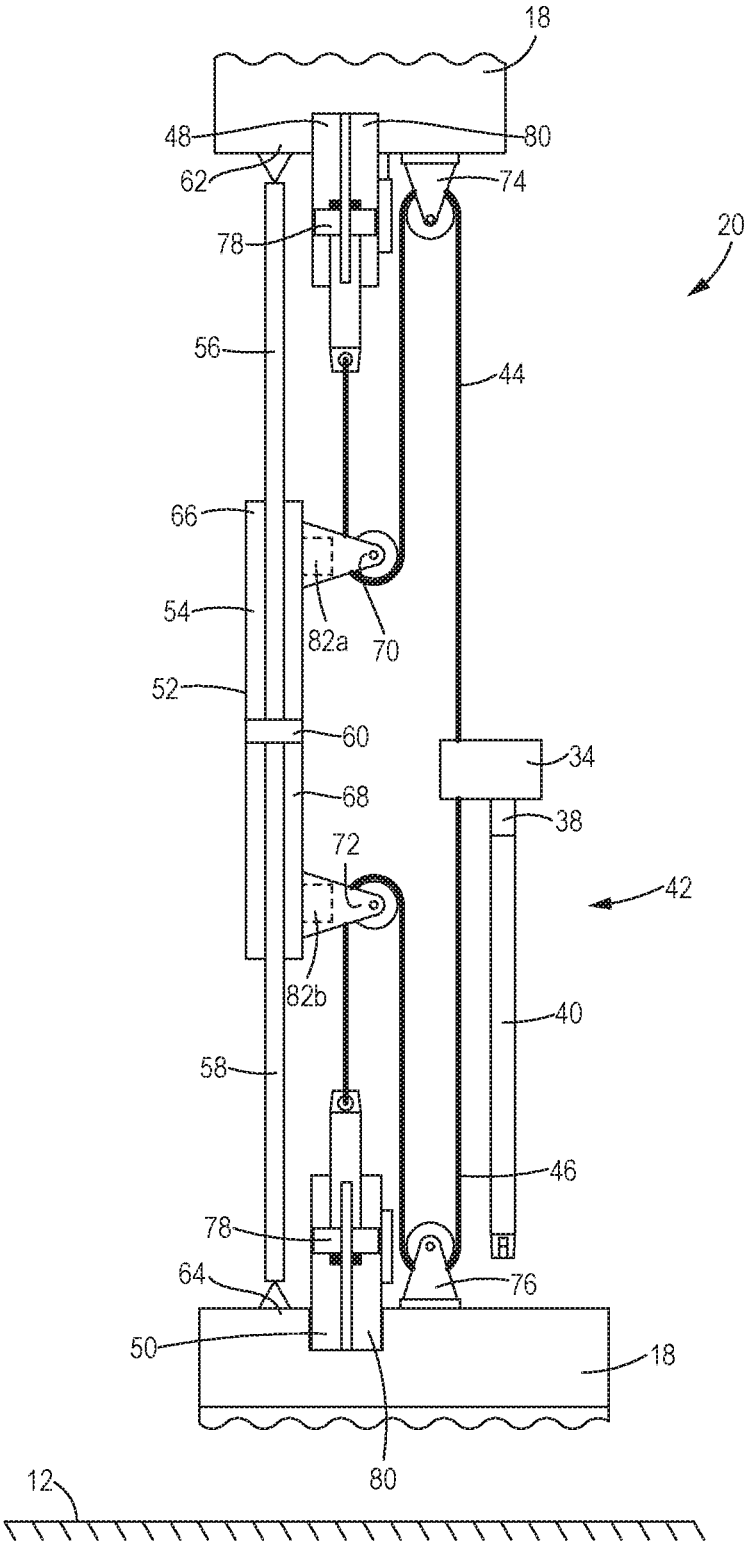
FIG. 4 is a partial schematic view of a cable feed system, in accordance with an embodiment of the present disclosure.

The drilling machine 10 includes a frame 14, a power source 16, a mast 18 and a cable feed system 20 (illustrated in FIG. 4). To effectuate one or more of movement, turning, positioning, and travel of the drilling machine 10 on the work surface 12, the frame 14 may be supported by at least one ground engaging mechanism 22. While the present drilling machine 10 is illustrated with a pair of endless track assemblies, the ground engaging mechanisms 22 may be of any suitable type, including wheels. Other machines (e.g. marine-based drilling machines), on the other hand, may not require or utilize any ground engaging mechanism 22. The drilling machine 10 may further include one or more jacks 24. The jacks 24 may be configured to support and/or stabilize the drilling machine 10 on the work surface 12 during operation.

With continued reference to FIG. 1, the power source 16 may be mounted on the frame, and may include any suitable power source or system capable of generating and/or supplying power to operate the drilling machine 10, as well as its systems and components thereof, as disclosed herein. Non-limiting examples of the power source 16 may include, for example, a diesel engine, a gasoline engine, a gaseous fuel-powered engine, an electrical motor, a fuel cell, a battery, and/or combinations thereof. The frame 14 may also support batteries, pumps, air compressors, hydraulic fluid storage and other equipment necessary to power and operate the drilling machine 10 that is not specifically numbered.

In the illustrated embodiment, the drilling machine 10 is an operator operated machine, and thus includes an operator cab 26. However, in various other embodiments, the drilling machine 10 may be an autonomous machine, a semiautonomous machine, a remotely operated machine, or a remotely supervised machine, among others. The operator cab 26 may be mounted to the frame 14, and may include one or more control devices 28 that a user or operator may use to maneuver and control the drilling machine 10. These control devices 28 may include one or more joysticks, pedals, levers, buttons, steering wheels, or any other suitable control device or interface (or any of various combinations thereof) configured to be actuated or otherwise engaged to effectuate control of the drilling machine 10. The operator cab 26 may also include a display unit (not shown) for displaying visual data pertaining to the components and/or the current operations of the drilling machine to the operator stationed within the operator cab. The display unit may be included as a control device 28 when it is configured as a tablet computing device (or otherwise consistent therewith), such that, through the display unit, the operator may interact with, control, and/or operate the various systems of the drilling machine 10.

As further illustrated in FIG. 1, the mast 18 is mounted on the frame 14 of the drilling machine 10. The mast 18 (also referred to as a derrick or tower) may move relative to the frame 14 between a substantially vertical position and a non-vertical position in order to vary the angle of drilling. The mast 18 may include a top end 30, generally referred to as a "crown," and an opposite bottom end 32, generally referred to as a "mast base." The cable feed system 20 may be positioned between the top end 30 and the bottom end 32 of the mast 18.

Figure 2:
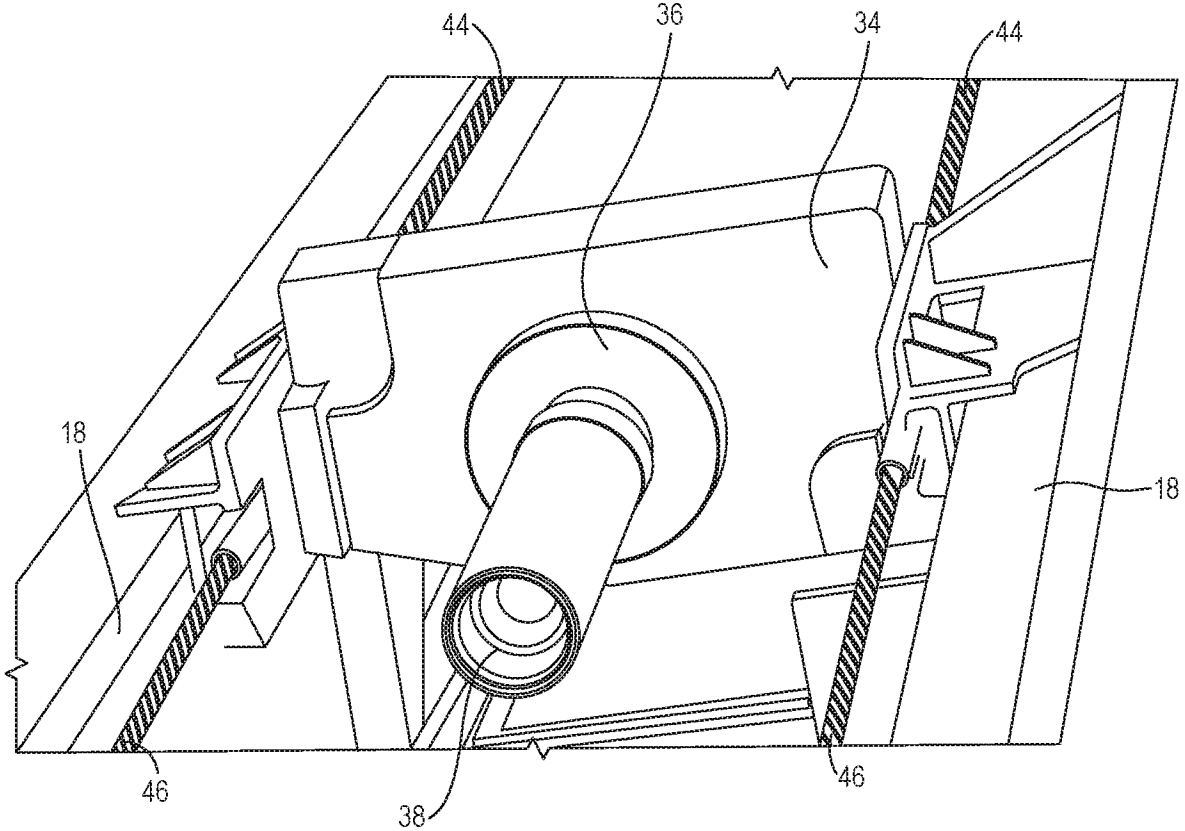
FIG. 2 is a bottom perspective view of a rotary drill head assembly and a portion of a mast frame of the drilling machine of FIG. 1 constructed in accordance with an embodiment of the present disclosure.
Figure 3:
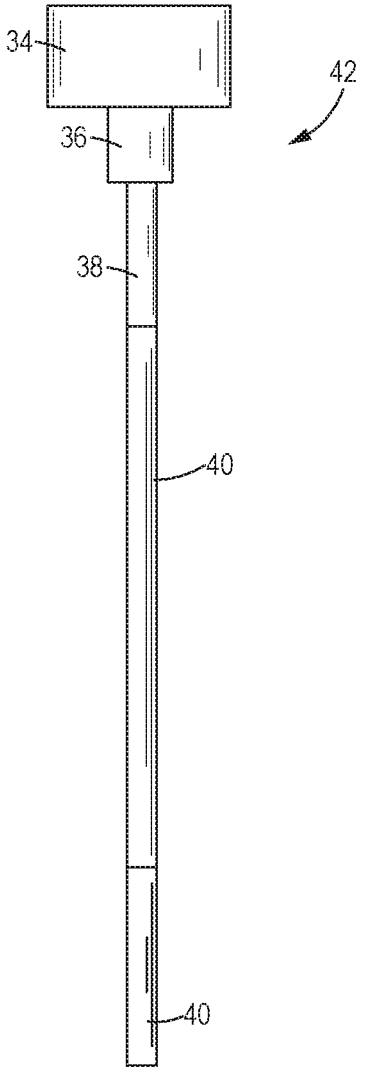
FIG. 3 is a side view of a drill string, in accordance with an embodiment of the present disclosure.

Referring now to FIGS. 2 and 3, a portion of the mast 18 is illustrated, along with a rotary drill head assembly 34. The rotary drill head assembly 34 may be actuated to travel up and down along the length of the mast 18 between the top end 30 and the bottom end 32, and may be positioned at any of a plurality of positions therebetween. Specifically, the rotary drill head assembly 34 may be hoisted and lowered along the mast 18 using a set of cables 44, 46 connected to a hydraulic feed cylinder 52 (FIG. 4). The cables 44, 46 may comprise a metallic cable, a braid of high tensile strength wires, a composite cable, or any other suitable cable known in the art. An operator may direct the hoisting and lowering of the rotary drill head assembly 34 from the operator cab 26 using the one or more control devices 28 or other means. The rotary drill head assembly 34 may include a housing 36, with at least a portion of the housing defining a threaded coupling 38 that may matingly engage a corresponding threaded coupling in a pipe segment 40 to form a drill string 42. The drill string 42 may include the rotary drill head assembly 34, one or more pipe segments 40, and a drill bit (not shown) coupled to an end of the drill string opposite the rotary drill head assembly. The drill string 42 may be lengthened or shortened by adding or removing pipe segments 40. During operation of the drilling machine 10, the rotary drill head assembly 34 rotates the drill string 42, thereby rotating the drill bit, in order to create a hole of the desired size and depth. Hydraulics (not shown) or similar means may be used to rotate the drill string 42.

Turning now to FIG. 4, the cable feed system 20 is schematically illustrated. The cable feed system 20 includes the drill string 42, a first cable 44, a second cable 46, a first tensioning device 48, a second tensioning device 50, and the feed cylinder 52. More specifically, the cable feed system 20 includes a dual rod, single piston type hydraulic feed cylinder 52 having a cylinder body 54, a first piston rod 56, a second piston rod 58, and a common piston 60. The first piston rod 56 and the second piston rod 58 may be attached to the common piston 60 and slidably disposed within the cylinder body 54. The first piston rod 56 may extend outwardly from the common piston 60 and the cylinder body 54 to an upper mounting surface 62 of the mast 18. Similarly, the second piston rod 58 may extend outwardly from the common piston 60 and the cylinder body 54 to a lower mounting surface 64 of the mast 18. The common piston 60 divides the cylinder body 54 into an upper chamber 66 and a lower chamber 68.

The cable feed system 20 may also include a first pulley 70 coupled to the upper chamber 66 of the cylinder body 54, and a second pulley 72 coupled to the lower chamber 68 of the cylinder body. As such, the first and second pulleys 70, 72 may be configured to travel linearly up and down, along with, in unison with, and by virtue of the actuation and corresponding movement of the hydraulic feed cylinder 52. The cable feed system 20 may also include a third pulley 74 fixed to the upper mounting surface 62 of the mast 18, and a fourth pulley 76 fixed to the lower mounting surface 64 of the mast. The first cable 44 may be coupled, at one end, to the rotary drill head assembly 34, and at an opposite end to the first tensioning device 48, such that the first tensioning device maintains the first cable in a taut configuration or condition (i.e. in tensioned condition with no slack in the first cable). The first cable 44 may extend through, and engage, both the first pulley 70 and the third pulley 74. The second cable 46 may similarly be coupled, at one end, to the rotary drill head assembly 34, and at an opposite end to the second tensioning device 50, such that the second tensioning device maintains the second cable in a taut configuration or condition (i.e. in tensioned condition with no slack in the second cable). The second cable 46 may extend through, and engage, both the second pulley 72 and the fourth pulley 76.

The taut configuration of the first cable 44 and the second cable 46 may be imparted by the first tensioning device 48 and the second tensioning device 50 respectively. In particular, each tensioning device 48, 50 includes at least one element that may be actuated to move (e.g., retract) to adjust the tension of the first and second cables 44, 46 thereby maintaining tension each of the first and second cables. In the illustrated embodiment, the actuating element is embodied as a piston 78 disposed within a hydraulic cylinder 80 and configured to actuate linearly within the cylinder. However, other methods may be used for maintaining and adjusting tension, as is known in the art.

The cable feed system 20 may further include a plurality of pressure sensors 82 or other mechanisms configured to measure at least hydraulic fluid pressure values of the cable feed system. As illustrated in FIG. 4, the cable feed system 20 may include a hoist pressure sensor 82*b*, and a pulldown pressure sensor 82*a*. Each pressure sensor 82*a*, 82*b* may be configured to measure multiple forces acting on the hydraulic feed cylinder 52 at once, and consequently may be disposed on, within, or proximate to opposite ends of the hydraulic feed cylinder in hydraulic fluid lines (not shown). In one embodiment, the pulldown pressure sensor 82*a* may be positioned in a hydraulic fluid line (not shown) proximate a hydraulic pump (not shown) that may be coupled to the hydraulic feed cylinder 52, while the hoist pressure sensor 82*b* may be positioned in a hydraulic fluid line (not shown) proximate the hydraulic feed cylinder 52. Measurements taken by the pressure sensors 82 may be communicated to an electronic controller (discussed in further detail below) and used therein to calculate a number of values, including a weight of the drill string 42. Other sensors may also be used in association with the first and second cables 44, 46 to measure, among other things, tension, length, position, tensile force, and strain.

With continued reference to FIG. 4, and additional reference to FIGS. 1-3, during operation of the drilling machine 10, pipe segments 40 may be added to, or removed from, the drill string 42 to lengthen or shorten the drill string. For example, additional pipe segments 40 may be added to allow a deeper hole to be drilled. Additional pipe segments 40 may be stored in a pipe segment carousel 84, and may be used in rotation. As mentioned above, adding a pipe segment 40 to the drill string 42 with worn or thin walls, may result in failure of the pipe segment and create costly down-time of the drilling machine 10. To prevent such failure, the drilling machine 10 includes a pipe life monitoring system 100, which monitors the weight of each pipe segment 40 as it is added to, or removed from, the drill string 42.

Figure 5:
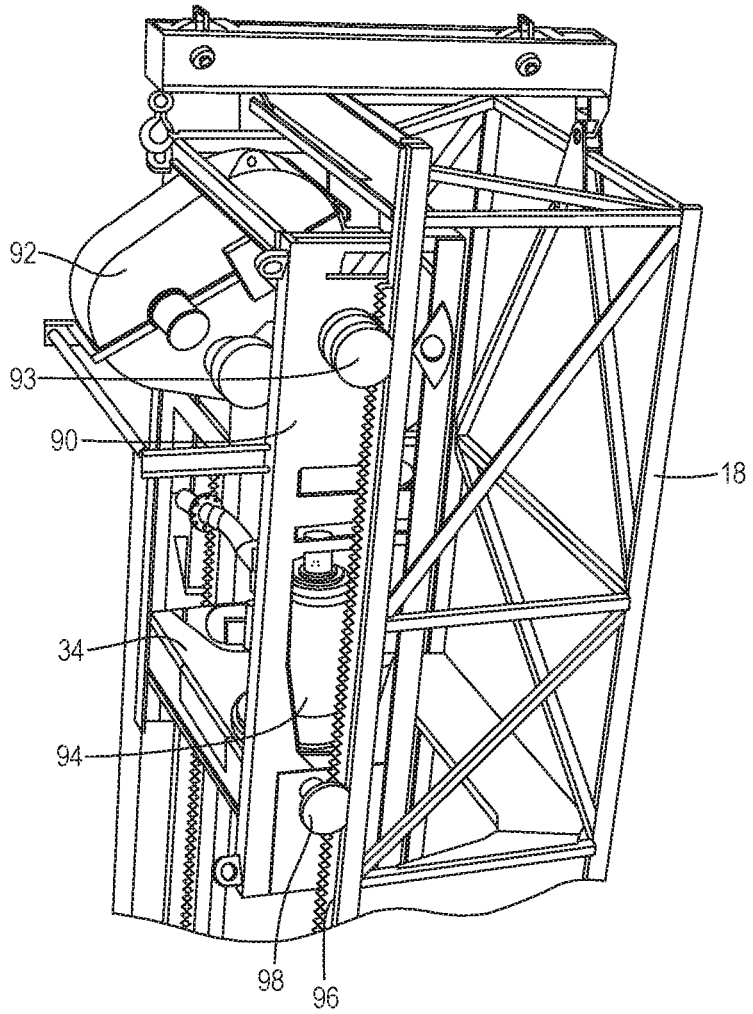
FIG. 5 is an elevated perspective view of an electric drive system and a portion of a mast frame of a drilling machine, in accordance with an embodiment of the present disclosure.

In an alternative embodiment, as illustrated in FIG. 5, an electric drive system may be used to raise and lower the rotary drill head assembly 34 along the mast 18. The electric drive system includes a gear case 90 housing an electric drive motor 92, an electric rotary motor 94, and the rotary drill head assembly 34, among other components. The electric drive motor 92 may hoist and lower the gear case 90, including the rotary drill head assembly 34, through rotation of a pinion (not shown) of the drive motor that may be coupled to a rack gear 93. The rack gear 93 may include teeth (not shown) that matingly engage a toothed rack 96 fixed to the mast 18. An idler wheel 98, which may also engage the rack 96, may be used to stabilize a lower portion of the gear case 90 as it travels up and down the mast 18. To prevent the gear case 90 from drifting or falling when not commanded to move, the electric drive system may include brakes (not shown). The rotary motor 94 may control the rotation of the drill string 42 to facilitate loading of each pipe segment 40 onto the drill string and removal of each pipe segment from the drill string. The speed and direction of the electric drive system, as well as the rotation of the rotary drill head assembly 34 may be adjusted by the operator of the drilling machine 10 through a joystick or other similar means present in the operator cab 26. The electric drive system may monitor the torque output of the electric drive motor 92 using a plurality of torque sensors 99 (not shown).

Figure 6:
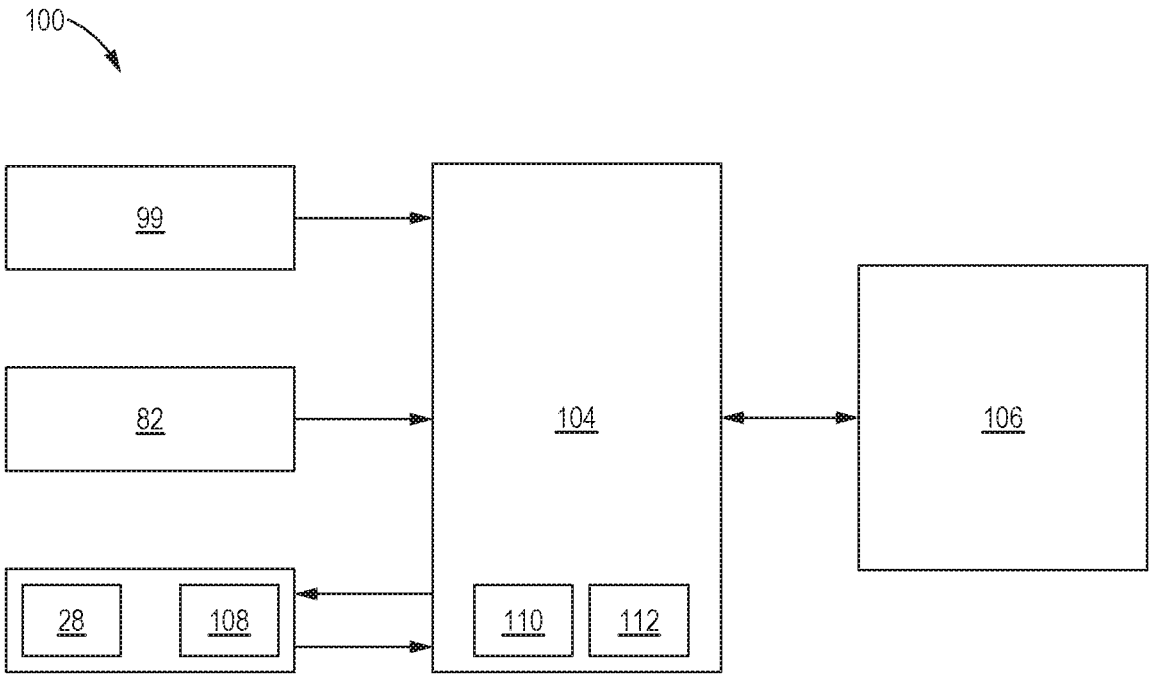
FIG. 6 is a schematic illustration of a pipe life monitoring system, in accordance with an embodiment of the present disclosure.

As illustrated in FIG. 6, with continued reference to FIGS. 1-4, the pipe life monitoring system 100 includes the plurality of torque sensors 99, the plurality of pressure sensors 82, an operator system 102, an electronic controller 104, and a machine management system 106. The plurality of pressure sensors 82 and the plurality of torque sensors 99 are in electronic communication with the controller 104, and transmit data signals, readings, and/or sensed measurements electronically for processing. The operator system 102 may be configured to receive input from an operator of the drilling machine 10 via the one or more control devices 28, and to transmit that input to the controller 104. The controller 104 may include any type of device or any type of component that may interpret and/or execute information and/or instructions stored within a memory 110 to perform one or more functions. For example, the controller 104 may use received information and/or execute instructions to determine a health of a pipe segment 40 on the drill string 42 by calculating a current weight of the pipe segment based on a pressure exerted by the drill string (measured by the plurality of pressure sensors 82), and comparing the current weight to an original weight of the pipe segment.

The memory 110 may include a random access memory ("RAM"), a read only memory ("ROM"), and/or another type of dynamic or static storage device (e.g., a flash, magnetic, or optical memory) that stores information and/or instructions for use by the example components, including the information and/or instructions used by the controller 104. Additionally, or alternatively, the memory may include non-transitory computer-readable medium or memory, such as a disc drive, flash drive, optical memory, read-only memory (ROM), or the like. The memory may store the information and/or the instructions in one or more data structures, such as one or more databases, tables, lists, trees, etc. The controller 104 may also include a processor 112 (e.g., a central processing unit, a graphics processing unit, an accelerated processing unit), a microprocessor, and/or any processing logic (e.g., a field-programmable gate array ("FPGA"), an application-specific integrated circuit ("ASIC"), etc.), and/or any other hardware and/or software. The controller 104 may also transmit, via a network (not shown), information regarding the pressure exerted on the hydraulic feed cylinder 52, as well as calculated values such a weight of the drill string 42 and individual pipe segments 40 on the drill string. For example, the controller 104 may be configured to provide output to the operator system 102 for display on one or more display units 108 that may be visible by the operator of the drilling machine 10, but which may also be visible by machine technicians, and others with access to the pipe life monitoring system 100. Similarly, the controller 104 may transmit, via a network, information to the machine management system 106.

While the controller 104 may be operatively associated with the drilling machine 10, the machine management system 106 may be located at the worksite, or alternatively may be located remotely from the worksite. While not shown, the machine management system 106 may also include at least one memory (e.g., a database) and processor, as described above in relation to the controller 104. The machine management system 106 may be electronically coupled to a plurality of controllers associated with a plurality of work machines and other vehicles, such that data associated with each work machine may be stored in a central location and may be accessible by machine operators, technicians, data analysts, and others, as needed.

As discussed above and further discussed herein, the pipe life monitoring system 100, and the included and/or associated components thereof, including, in part, the torque sensors 99, the pressure sensors 82 and the controller 104, is configured to continuously monitor, process, and determine, in part, the performance, operating condition, and/or remaining useful life of pipe segments 40 in real time. The pipe life monitoring system 100 is therefore configured to provide notification, in real time, to the operator and/or the machine management system 106, as disclosed herein, of the current operating condition and/or remaining useful life of each pipe segment 40, as determined by the controller 104. In providing such notification, the pipe life monitoring system 100, and controller 104 thereof, can provide the operator and/or technicians accessing the machine management system 106 with the opportunity to take any appropriate responsive actions, including but not limited to actions relating to the operation of the drilling machine 10. Responsive actions may be necessary to prevent any damage to the pipe segment 40, as well as any associated components of the drill string 42 and/or the drilling machine 10. Such notification from the pipe life monitoring system 100 can further provide the operator and/or user of the machine management system 106 with the opportunity to coordinate, plan, and schedule timely procurement and deployment of maintenance services and/or personnel to ensure replacement of one or more of the pipe segments 40 as necessary to prevent any machine downtime or loss in productivity.

INDUSTRIAL APPLICABILITY

In practice, the teachings of the present disclosure may find applicability in many industries including, but not limited to, drilling and mining equipment. For example, the present disclosure may be beneficial to mobile drills, fixed platform drills, blast-hole drills, rotary drills, and other machines utilizing cable pulley systems, such as cranes. More particularly, the present disclosure provides a pipe life monitoring system 100 to determine a weight of an individual pipe segment as it is being added to, or removed from, a drill string. The weight of the pipe may then be used to determine an approximate remaining life left for the pipe segment.

Figure 7:
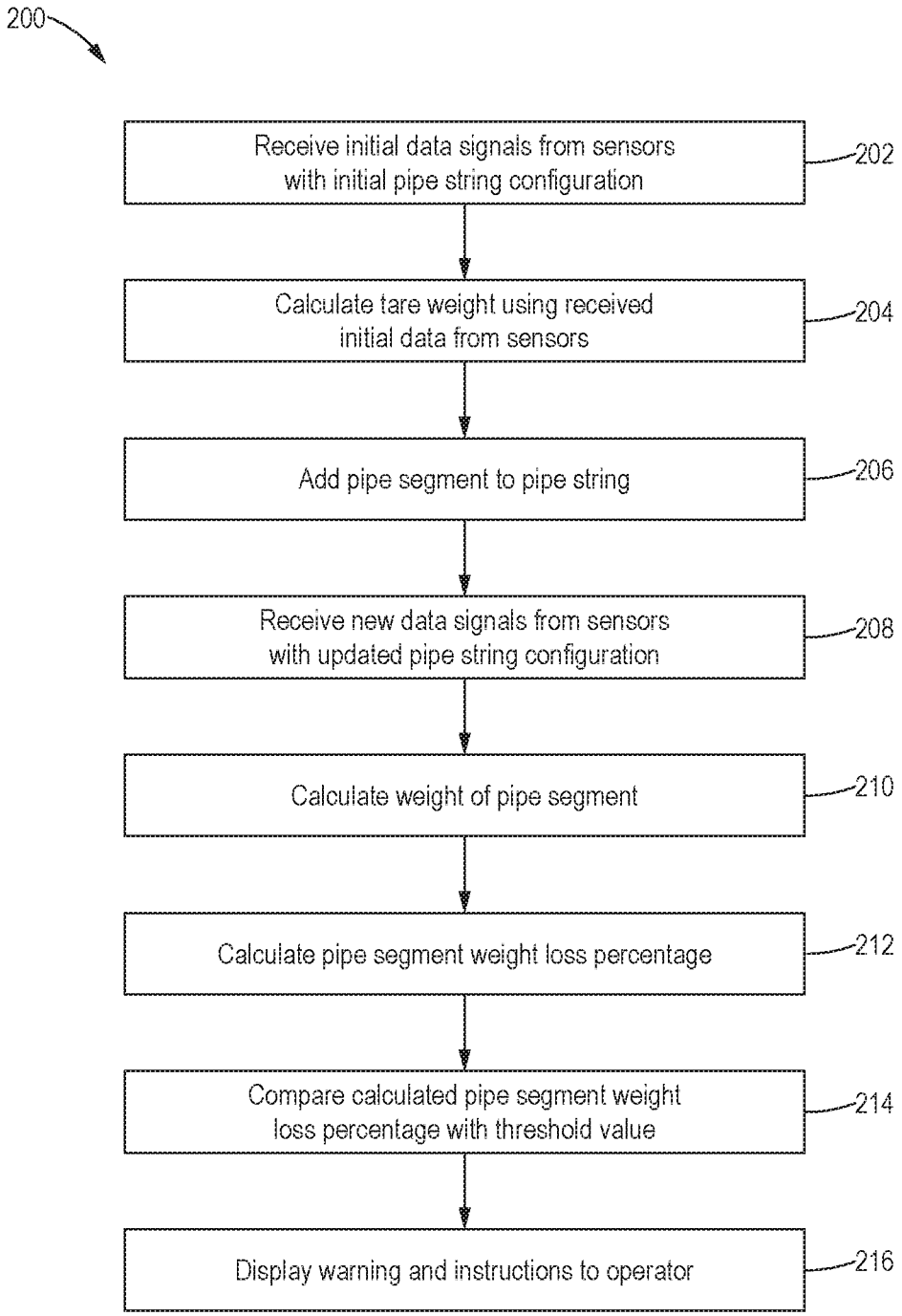
FIG. 7 is a flowchart illustrating a method of calculating and signaling a condition of a pipe segment installed on a drill string, in accordance with the present disclosure.

A series of steps 200 involved in monitoring the health of the pipe segment 40 of the drilling machine 10 is illustrated in a flowchart format in FIG. 7. The series of steps 200 may be performed by the controller 104, except for step 206, as will be discussed below. As shown in FIG. 7, in a first step 202, data from each sensor, including pressure sensors 82*a*, 82*b* or torque sensor 99, along with data measured by other sensors (not shown), such as a height of the drill string 42, may be received by the controller 104. Monitoring and transmitting the received pressure or torque data may be accomplished through any means known in the art, including, for example, through the use of the plurality of pressure sensors 82 or torque sensor 99. Similarly, while monitoring and transmitting the velocity of the drill string 42 may be accomplished by operatively coupling the controller 104 or other computer-implemented system to the electric drive motor 92 or a motor (not shown) of the hydraulic cable feed system 20, or by other methods and systems known in the art, the velocity of the drill string 42 may also be calculated using, for example, the pressure values obtained from the pressure sensors 82.

In one embodiment, the pressure data received by the controller 104 during the receiving step 202 includes data gathered by the pressure sensors 82. More specifically, the pulldown pressure sensor 82*a* may measure the hydraulic fluid pressure exerted in a hydraulic fluid line connected to the hydraulic feed cylinder 52 at a top end proximate the first pulley 70. The hoist pressure sensor 82*b* may simultaneously measure the hydraulic fluid pressure exerted in a hydraulic fluid line connected to the hydraulic feed cylinder 52 at a bottom end proximate the second pulley 72. The pressure sensors 82*a*, 82*b* may transmit this data (collectively referred to hereinafter as "pressure data") to the controller 104.

In an alternative embodiment, the torque data received by the controller 104 during the receiving step 202 includes data gathered by the torque sensor 99. More specifically, the torque sensor 99 may measure the torque on a pinion (not shown) of the electric drive motor 92, and thus may be installed on or proximate the pinion. The torque sensor 99 may transmit this torque data to the controller 104.

The controller 104 may first use the pressure or torque data to calculate a tare weight (also called a "zero weight") of the drill string 42 (step 204). In one embodiment, the tare weight may be calculated with no pipe segments 40 installed on the drill string 42, such that the calculated tare weight may be equivalent to the weight of the rotary drill head assembly 34. Alternatively, the tare weight may be calculated with one or more pipe segments 40 already installed on the drill string 42, such that the calculated tare weight may be equivalent to the weight of the rotary drill head assembly 34 plus the weight of the one or more installed pipe segments 40. The tare weight, or zero weight, acts as a baseline value, such that when a pipe segment 40 is added to the drill string 42 or removed from the drill string, the weight of that added or removed pipe segment 40 may be determined.

The weight of the drill string 42 may be calculated by the controller 104 using the pressure data. In this embodiment, the pressure data is measured while the drill string 42 is hoisted at a constant, slow velocity. Preferably, to minimize impacts from drag and other inefficiencies, the pressure data is measured while the drill string 42 is hoisted at a maximum velocity of only a few mm/sec or less. Using the pressure data, the weight ($W_{string}$) of the drill string is calculated according to the following formula:

$$W_{String}=((P_{Hoist}\times A_{Hoist}-P_{Pulldown}\times A_{Pulldown})/PR*e)/\cos(\theta_M)$$

where $P_{Hoist}$ is the pressure measured by the hoist pressure sensor 82*b* and $P_{Pulldown}$ is the pressure measured by the pulldown pressure sensor 82*a*. $A_{Hoist}$ and $A_{Pulldown}$ are the hoist force acting area and the pulldown force acting area, which may be calculated using surface area dimensions related to the hydraulic feed cylinder 52. PR is a pulley ratio, which is calculated as the ratio of the speed of the hydraulic feed cylinder 52 output to the speed of the rotary drill head assembly 34. Finally, e is an efficiency factor, which may be calculated or predetermined, and OM is the angle of the mast 18 relative to the ground surface.

In an alternative embodiment, the tare weight of the drill string 42 may be calculated by the controller 104 using the torque data supplied by the torque sensor 99. In this alternative embodiment, the torque data is measured while the drill string 42 is hoisted at a constant, slow velocity. Preferably, to minimize impacts from drag and other inefficiencies, the pressure data is measured while the drill string 42 is hoisted at a maximum velocity of only a few mm/sec or less. Using the torque data, the weight ($W_{String}$) of the drill string is calculated according to the following formula:

$$W_{String}=T_p/r_p$$

where $T_p$ is the torque on the pinion (not shown) measured by the torque sensor 99, and $r_p$ is the effective radius of the pinion, measured from the electric drive motor 92 to the rack 96.

Once the tare weight has been calculated by the controller 104, an additional pipe segment 40 may be added to the drill string 42 (step 206). To add a pipe segment 40 to the drill string 42, the rotary drill head assembly 34 is hoisted up the mast 18 to a position above the pipe segment carousel 84. A pipe loader assembly (not shown) may move the pipe segment 40 into line with the rotary drill head assembly 34. The rotary drill head assembly 34 may then be lowered, such that the threaded coupling 38 of the rotary drill head assembly matingly engages a threaded coupling (not shown) of the pipe segment 40. The rotary drill head assembly 34 and the pipe segment 40 may be securely screwed together, such that the pipe segment forms a portion of the drill string 42. The drill string 42 may then be slowly hoisted upwards, allowing the pipe loader assembly to return to its original position. While the drill string 42 is hoisted upwards, data from each pressure sensor 82*a*, 82*b* or torque sensor 99, may be transmitted to, and received by, the controller 104 (step 208).

Alternatively, once the tare weight has been calculated by the controller 104, a pipe segment 40 already on the drill string 42 may be removed from the drill string (step 206). To remove a pipe segment 40 from the drill string 42, the rotary drill head assembly 34 and pipe segment 40 are separated from the remainder of the drill string 42, and are hoisted up the mast 18 to a position above the pipe segment carousel 84. At this time, while the drill string 42 is hoisted upwards, data from each pressure sensor 82*a*, 82*b* or torque sensor 99, may be transmitted to, and received by, the controller 104 (step 208). The pipe segment 40 may then be disconnected from the rotary drill head assembly 34, and moved into an available storage spot in the pipe segment carousel 84. The rotary drill head assembly 34 is then lowered and connected to the next pipe segment 40 of the drill string 42.

The controller 104 may then use the pressure or torque data obtained in step 208 to calculate a weight of the pipe segment 40 that was added or removed from the drill string 42 (step 210). More specifically, the controller 104 first uses the pressure data or torque data obtained in step 208 to calculate an updated weight. This updated weight may be either higher than the tare weight (if a pipe segment 40 was added to the drill string 42), or lower than the tare weight (if a pipe segment 40 was removed from the drill string 42). Regardless, the absolute value of the difference between the tare weight and the updated weight may be equivalent to the isolated weight of the pipe segment 40 that was added to, or removed from, the drill string 42.

At step 212, a pipe segment weight loss ratio may be calculated. The weight loss ratio may be calculated by dividing the calculated isolated weight of the pipe segment 40 by its original weight (before the pipe segment was used in operation). This weight loss ratio indicates what percentage of material of the pipe segment 40 has been lost due to use in operation. Because a pipe segment 40 may not erode uniformly during use, the weight loss ratio informs operators and technicians alike as to exactly how much material has eroded away from the pipe segment 40 as a result of the drilling operation.

The weight loss ratio may be compared to a predetermined threshold of acceptable loss (step 214). The predetermined threshold may be stored in the memory 110 associated with controller 104 or the machine management system 106, and may be set or adjusted by technicians and other work site personnel. A universal or default predetermined threshold may be in a range of 0% to 20%. However, the predetermined threshold may be adjusted depending on the type of material the drilling machine 10 is drilling into, the downward speed of the drilling, and the rotational speed of the drilling, among others. If the weight loss ratio value is at, or below, the predetermined threshold, the controller 104 may store the calculated weight of the pipe segment 40 and the weight loss ratio in the memory 110 of the controller and also in the machine management system 106 (associated with a data entry related to that specific pipe segment 40). Optionally, the controller 104 may also transmit the calculated weight loss percentage to the display unit 108 of the operator system 102.

If, however, the weight loss ratio value is above the predetermined threshold, then it may be determined that the pipe segment 40 is operating under a possibility of impeding failure, and a pipe segment failure warning may be triggered (step 216). As before, the controller 104 may store the calculated weight of the pipe segment 40 and the weight loss ratio in the memory 110 of the controller and also in the machine management system 106 (associated with a data entry related to that specific pipe segment 40). However, the controller 104 will also transmit the calculated weight loss percentage to the display unit 108 of the operator system 102, along with a warning and an instruction to the operator of the drilling machine 10. The color and style (e.g. with audible alert, flashing, etc.) of the warning and instruction may vary depending on the severity of the deviation from the predetermined allowable threshold. A weight loss ratio value that is only 5% above the predetermined threshold may, for example, result in a yellow alert and an instruction to the operator of the drilling machine 10 to closely monitor drill performance statistics including rotational speed, temperature, and other data. A weight loss ratio value that is 20%, for example, above the predetermined threshold may result in a red, flashing alert, along with an audible alarm, and an instruction to the operator of the drilling machine 10 to remove the pipe segment 40 from use immediately.

While a series of steps and operations have been described herein, those skilled in the art will recognize that these steps and operations may be re-arranged, replaced, or eliminated, without departing from the spirit and scope of the present disclosure as set forth in the claims.

With implementation of the present disclosure, operators of drilling machines may be alerted of a possible failure of a pipe segment before a catastrophic failure occurs. With early indication of possible failure, drilling machine operators and technicians may conveniently plan to perform replacement, maintenance, and/or other service routines in a timely manner with little or no obstruction to an ongoing procedure in a worksite. Moreover, upon detection of a possible failure, operators may conveniently perform the necessary actions, as the present disclosure is configured to additionally provide a manner of taking corrective actions to prevent failure. Furthermore, with implementation of the present disclosure, time and effort previously incurred with maintenance of pipe segments may be offset, saving costs to operators of drilling machines.

While aspects of the present disclosure have been particularly shown and described with reference to the embodiments above, it will be understood by those skilled in the art that various additional embodiments may be contemplated by the modification of the disclosed machines, systems and assemblies without departing from the scope of what is disclosed. Such embodiments should be understood to fall within the scope of the present disclosure as determined based upon the claims and any equivalents thereof.

What is claimed is:

1. A drilling machine with a pipe life monitoring system, the drilling machine comprising:

a drill string including at least a rotary drill head assembly and a pipe segment;

a sensor configured to monitor and transmit sensor data, the sensor data including a torque output of an electric drive motor of the rotary drill head assembly or a hydraulic fluid pressure; and a controller, including a processor, the controller operatively associated with the sensor, the controller configured to calculate a weight of the pipe segment using the sensor data.

2. The drilling machine of claim 1, wherein the controller is further configured to calculate a pipe weight ratio based on the calculated weight of the pipe segment and a manufacturing weight of the pipe segment.

3. The drilling machine of claim 2, wherein the controller is further configured to display a warning to an operator of the drilling machine when the calculated pipe weight ratio exceeds a predetermined threshold value.

4. The drilling machine of claim 1, further including a feed cylinder configured to facilitate movement of the drill string along a mast of the drilling machine.

5. The drilling machine of claim 4, wherein the feed cylinder is coupled to a hydraulic fluid system of the drilling machine.

6. The drilling machine of claim 5, further including a pulley coupled to the feed cylinder; and a cable threaded through the pulley, the cable coupled to the rotary drill head assembly.

7. The drilling machine of claim 6, further including a hoist pressure sensor coupled to a first end of the hydraulic feed cylinder; and a pulldown pressure sensor coupled to a second opposite end of the hydraulic feed cylinder, the hoist pressure sensor and the pulldown pressure sensor being positioned in hydraulic fluid lines of the hydraulic fluid system of the drilling machine.

8. The drilling machine of claim 1, wherein the electric drive motor is configured to facilitate movement of the drill string along a mast of the drilling machine, the mast including a toothed rack.

9. The drilling machine of claim 8, further including a pinion operatively coupled to the electric drive motor, the pinion fixed to a rack gear with teeth that matingly engage the toothed rack as the drill string moves along the mast.

10. A pipe life monitoring system for a drilling machine including a drill string with a rotary drill head assembly, the pipe life monitoring system comprising:

a sensor configured to monitor and transmit sensor data, the sensor data including a torque output of an electric drive motor of the rotary drill head assembly or a hydraulic fluid pressure; and a controller, including a processor, in operative communication with the sensor, the controller configured to:

receive the sensor data transmitted by the sensor;

calculate a weight of the drill string using the received sensor data;

calculate, after a pipe segment is installed on the drill string, a weight of the pipe segment using the received sensor data;

calculate a pipe weight ratio based on the calculated weight of the pipe segment and a manufacturing weight of the pipe segment;

transmit a pipe segment failure warning to an operator of the drilling machine if the calculated weight ratio exceeds a predetermined ratio threshold value.

11. The pipe life monitoring system of claim 10, wherein the ratio threshold value is determined based on one or more of a substrate composite, a rotational speed of a drill bit, and a downward drilling speed.

12. The pipe life monitoring system of claim 10, wherein the pipe segment failure warning is transmitted to the operator via an electronic display.

13. The pipe life monitoring system of claim 12, wherein the operator of the drilling machine is provided, via the electronic display, operating instructions based on the pipe segment failure warning.

14. The pipe life monitoring system of claim 10, further including a hoist pressure sensor coupled to a first end of a feed cylinder, the hoist pressure sensor configured to monitor and transmit a hoist pressure exerted by hydraulic fluid in a hydraulic fluid line coupled to the first end of the feed cylinder; and a pulldown pressure sensor coupled to a second end of the feed cylinder opposite the first end, the pulldown pressure sensor configured to monitor and transmit a pulldown pressure exerted by hydraulic fluid in a hydraulic fluid line coupled to the second end of the feed cylinder.

15. The pipe life monitoring system of claim 10, wherein the controller is further configured to receive updated sensor data transmitted by the sensor after the pipe segment is installed on the drill string.

16. The pipe life monitoring system of claim 15, wherein the controller calculates the weight of the pipe segment using the received updated sensor data.

17. A method of detecting a failure of a pipe segment installed on a drill string of a drilling machine, the drill string including a rotary drill head assembly, the method comprising:

receiving initial sensor data from a pressure sensor or a torque sensor, the pressure sensor configured to measure a hydraulic fluid pressure, the torque sensor configured to measure a torque output of an electric drive motor of the rotary drill head assembly;

calculating an initial weight of the drill string using the received initial sensor data;

installing a pipe segment on the drill string;

receiving updated sensor data from the pressure sensor or the torque sensor;

calculating an updated weight of the drill string using the received updated sensor data;

calculating an initial weight of the pipe segment by subtracting the initial weight of the drill string from the updated weight of the drill string;

calculating an initial pipe weight ratio based on the calculated initial weight of the pipe segment and a manufacturing weight of the pipe segment; and transmitting a pipe segment failure warning to an operator of the drilling machine if the calculated initial pipe weight ratio exceeds a predetermined ratio threshold value.

18. The method of claim 17, further including operating the drilling machine for a period of time after the pipe segment is installed on the drill string.

19. The method of claim 18, further including:

receiving post-operation sensor data from the one of the pressure sensor and the torque sensor;

calculating a post-operation weight of the drill string using the received post-operation sensor data;

removing the pipe segment from the drill string;

receiving final sensor data from the one of the pressure sensor and the torque sensor;

calculating a final weight of the drill string using the received final sensor data;

calculating a final weight of the pipe segment by subtracting the post-operation weight of the drill string from the final weight of the drill string;

calculating a final pipe weight ratio based on the calculated final weight of the pipe segment and the manufacturing weight of the pipe segment; and transmitting the pipe segment failure warning to the operator of the drilling machine if the calculated final pipe weight ratio exceeds the predetermined ratio threshold value.

20. The method of claim 19, wherein the manufacturing weight of the pipe segment, the initial weight of the pipe segment, the final weight of the pipe segment, the calculated initial pipe weight ratio, and the calculated final pipe weight ratio are stored in the a memory of a pipe life monitoring system for the drilling machine.

* * * * *